US005562405A

United States Patent [19]

Ryall

[11] Patent Number: 5,562,405

[45] Date of Patent: Oct. 8, 1996

[54] MULTISTAGE AXIAL FLOW PUMPS AND COMPRESSORS

[75] Inventor: Michael L. Ryall, Killearn, Scotland

[73] Assignee: Weir Pumps Limited, Glasgow, Scotland

[21] Appl. No.: 401,413

[22] Filed: Mar. 9, 1995

[30] Foreign Application Priority Data

Mar. 10, 1994 [GB] United Kingdom ..... 9404653
Oct. 21, 1994 [GB] United Kingdom ..... 9421259

[51] Int. Cl.[6] ..... F04D 31/00

[52] U.S. Cl. ..... 415/72; 415/199.3; 415/221

[58] Field of Search ..... 415/71, 72, 199.2, 415/199.3, 221, 220

[56] References Cited

U.S. PATENT DOCUMENTS

| | | | |
|---|---|---|---|
| 1,554,591 | 9/1925 | Oliver | 415/72 |
| 2,749,027 | 6/1956 | Stalker . | |
| 3,442,220 | 5/1969 | Mottram et al. | 415/72 |
| 3,910,728 | 10/1975 | Sloan . | |
| 4,029,438 | 6/1977 | Sloan . | |
| 4,080,096 | 3/1978 | Dawson | 415/221 |
| 4,830,584 | 5/1989 | Mohn . | |
| 5,222,863 | 6/1993 | Jones . | |
| 5,425,617 | 6/1995 | Teran | 415/72 |

FOREIGN PATENT DOCUMENTS

| | | |
|---|---|---|
| 0080251 | 1/1983 | European Pat. Off. . |
| 0236166 | 9/1987 | European Pat. Off. . |
| 0475920 | 5/1992 | European Pat. Off. . |
| 0368160 | 3/1932 | United Kingdom . |
| 512487 | 9/1939 | United Kingdom . |
| 515469 | 12/1939 | United Kingdom . |
| 644319 | 10/1950 | United Kingdom . |
| 676371 | 7/1952 | United Kingdom . |
| 692188 | 6/1953 | United Kingdom . |
| 743475 | 1/1956 | United Kingdom . |
| 766812 | 1/1957 | United Kingdom . |
| 1119756 | 4/1968 | United Kingdom . |
| 1471222 | 4/1977 | United Kingdom . |
| 1561454 | 3/1980 | United Kingdom . |

OTHER PUBLICATIONS

"Poseidon Multiphase Technology", World Pumps, No. 319, pp. 16–17, Oxford.

*Primary Examiner*—Edward K. Look
*Assistant Examiner*—Michael S. Lee
*Attorney, Agent, or Firm*—Young & Basile

[57] ABSTRACT

A multistage axial flow pump or compressor comprises at least one stage (10) including a rotor (16) and a stator (20). The rotor (16) is arranged to impart whirl in one direction, while the stator (20) is arranged to impart whirl in the opposite direction. This arrangement is useful in providing comparatively high stage pressures for a given rotor tip velocity with relatively low rotor vane hydraulic loadings. The arrangement is also useful in pumping multiphase fluids.

25 Claims, 3 Drawing Sheets

MULTISTAGE AXIAL FLOW PUMPS AND COMPRESSORS

FIELD OF THE INVENTION

This invention relates to pumps and compressors, and in particular to multistage axial flow pumps and compressors.

BACKGROUND OF THE INVENTION

The invention has application in multistage pumps suitable for pumping a range of fluids, both liquids and gases, but also offers particular advantages in relation to axial pumps for use in pumping multiphase fluids as may be encountered in oil and gas exploration and production. Both the general and multiphase applications of the invention are described herein.

In existing multistage fluid pumps and compressors, whether of the centrifugal, mixed flow or axial flow type, an increase in fluid pressure is achieved in each stage by: an impeller, which imparts both whirl to the fluid and increases its pressure; and a diffuser or volute, which reduces the absolute velocity of the fluid and increases the fluid pressure further by the partial conversion of fluid velocity energy into pressure energy. In general, an objective in the design of these machines is that at the flow rate at which the hydraulic efficiency is a maximum that is, the design duty flow, a substantial amount of fluid diffusion takes place in the volute or bladed stators.

In order to achieve relatively high stage pressures it is generally necessary to employ centrifugal or mixed flow pumps. It is among the objects of one aspect of the present invention to provide a multistage axial flow pump which will provide a performance comparable with, or better than, a multistage centrifugal or mixed flow pump, at a lower manufacturing cost.

In many oil fields the fluid which is extracted from a hydrocarbon reservoir is a mixture of gas and liquid phases. During the pumping of such fluid, particularly at lower pressures, the gas phase tends to separate from the liquid phase, this problem being particularly acute within pump stages. In a conventional axial pump the gas phase tends to accumulate around the axis of the pump and to flow back along the pump axis.

Such conventional pumps typically comprise a cylindrical casing within which is mounted a rotatable shaft. An axial flow impeller, which may have a cylindrical or a conical hub, is mounted on the shaft directly upstream of a stationary diffuser. The impeller adds energy to the fluid while the diffuser reduces the absolute velocity of the fluid and increases the fluid pressure. The diffuser also serves to minimise the whirl velocity of the fluid at the diffuser outlet, and provides for substantially axial fluid flow from the stage. Due to the whirl imparted to the fluid by the impeller, separation of the gas and liquid phases towards the hub of both impeller and diffuser within the pump stages limits the gas-handling capability of such pumps. Accordingly, it is among the objects of another aspect of the present invention to provide a pump for multiphase fluids in which the gas phase remains substantially entrained within the liquid phase, thereby enhancing the ability of the pump to handle large gas fractions in the total fluid flow.

SUMMARY OF THE INVENTION

According to one aspect of the present invention there is provided a multistage axial flow pump or compressor comprising at least one stage including a rotor for imparting whirl in one direction and a stator for imparting whirl in the opposite direction.

According to another aspect of the present invention there is provided a method of pumping or compressing a fluid utilising a multistage pump or compressor including the steps: imparting whirl to the fluid in a first rotor; and then, imparting whirl to the fluid in the opposite direction in a first stator.

The present invention has application in both pumps and compressors however, in the interest of brevity, the description mainly refers to pumps.

In use, it has been found that pumps made in accordance with the invention are capable of providing corparatively high stage pressures for a given rotor tip velocity with relatively low rotor vane hydraulic loadings. Thus, it is possible to produce axial flow pumps and compressors according to the invention with equivalent or better performance than centrifugal and mixed flow pumps, and such axial flow pumps are likely to be significantly less expensive to produce than comparable centrifugal or mixed flow equivalents.

The configuration of the rotor and stator is such that the axial length per stage of pumps in accordance with the invention may be less than equivalent conventional axial flow, mixed flow and centrifugal machines, such that the invention allows construction of pumps and compressors with relatively short, stiff and rugged shafts and compact lightweight rotor assemblies.

Preferably, the pump rotor has a cylindrical hub, and rotates within a cylindrical housing.

Preferably also, the stator is configured to produce little or no diffusion, to maximise the efficiency of the whirl reversal process, and such that, at or near the design duty flow, the fluid is discharged from the stator with an absolute velocity which has substantially the same axial component as the fluid entering the stator, and has a whirl component of velocity which is substantially the same as the whirl component entering the stator, but in the opposite rotational direction. Thus, the absolute velocity of the fluid passing through the stator is maintained substantially constant during the whirl reversal process, the stator vanes effectively acting as a cascade bend.

Conveniently, means for diffusion of the fluid is provided after the last pump stage, for example by providing a bladed diffuser or volute.

Preferably also, the rotor of a second pump stage is arranged to impart a whirl component in the same direction as the direction of rotation of the rotor of the first stage.

According to a further aspect of the present invention there is provided an axial flow pump for use in pumping a multiphase fluid, the pump comprising at least one stage having a rotor for imparting whirl in one direction and a stator for imparting whirl in the opposite direction to maintain entrainment of the gas phase of the fluid within the liquid phase.

Compared to conventional pump stage arrangements, in which the whirl induced in the fluid is likely to be unidirectional, the maximum whirl velocity attained in the stage is considerably lower, thus reducing the centrifugal forces acting on the fluid and which tend to separate the phases. Also, the arrangement of the invention avoids the fluid being subject to a continuous centrifuging effect. The changes in direction of whirl also tend to induce re-entrainment of any gas that has nevertheless separated from the liquid phase.

Preferably, said at least one stage includes two stators, one upstream and downstream of the rotor, the stators inducing whirl in one direction and the rotor inducing whirl in the opposite direction.

The stage may be arranged such that the pressure rise across the stage is predominately achieved in the rotor, the stator serving solely or predominately to change the direction of whirl of the fluid. Alternatively, the stator may act as a diffuser. In the former arrangement the rotor may be mounted on a parallel cylindrical hub, to produce purely axial flow, while in the latter arrangement the rotor may be mounted on a conical hub.

Preferably also, the rotor is in the form of an impeller mounted on a rotating shaft. Most preferably, the stator is mounted to the casing which defines the outer wall of the pump stage.

Preferably also, the stator is formed of a plurality of radially extending blades or vanes. Most preferably, the stator downstream of the rotor has bull-nosed vanes that is vanes with a blunt, rounded leading edge, capable of tolerating a wide range of flow incidence angles at the bull-nosed leading edges. Preferably also, the profile of the vanes is such as to provide substantially constant passage width between the vanes.

BRIEF DESCRIPTION OF THE DRAWINGS

These and other aspects of the present invention will now be described, by way of example, with reference to the accompanying drawings, in which.

DETAILED DESCRIPTION OF PREFERRED EMBODIMENTS

Figure 1:
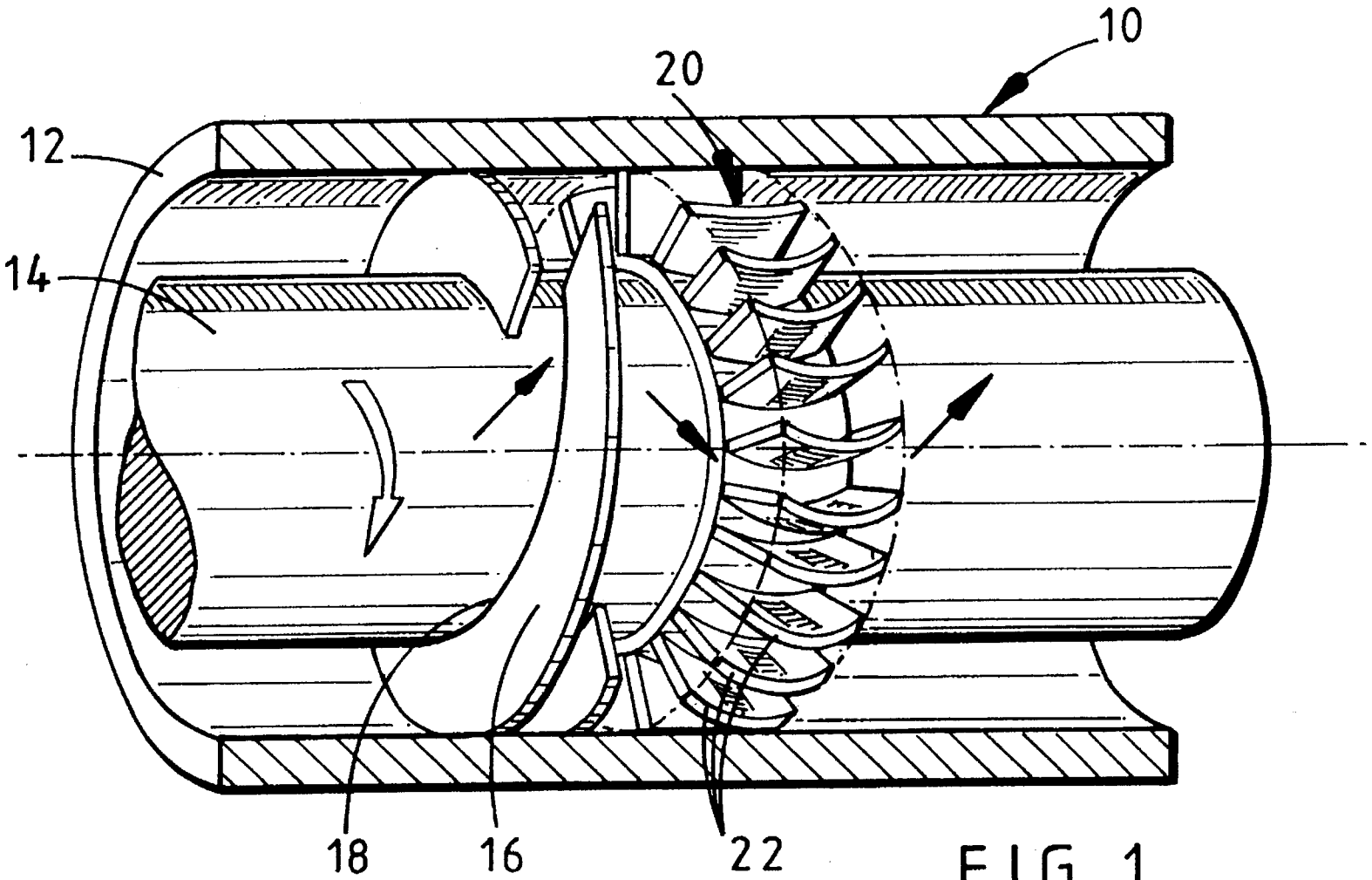
FIG. 1 is a cut-away view of a stage of a multistage axial pump in accordance with a preferred embodiment of the present invention.

Reference is first made to FIG. 1 of the drawings, which illustrates one stage of a multistage axial pump in accordance with an embodiment of the present invention. The pump stage 10 is located within a cylindrical casing 12 which contains a central driving shaft 14. A rotor 16 is linked to the driving shaft 14 via a cylindrical hub 18. Downstream of the rotor 16 is a stator 20 having blades 22 which are fixedly mounted within, brazed to, or cast integral with the casing 12. The stator blades 22 are generally similar to the rotor blades of an axial flow impulse type steam turbine, and effectively act as cascade bends.

In use, the rotor 16, which in this example is rotated in a clockwise direction, induces clockwise whirl in the fluid, which is then reversed by the stator 20. The flow of fluid through the stage 10 is illustrated in greater detail in FIG. 2 of the drawings, which shows a section of the pump stage 10, including three blades 24 of a first stator 26 and three blades 22 of a second stator 20, the rotor 16 being located therebetween. Considering first the path of the fluid from the rotor 16 to the downstream stator 20, the fluid whirl is generated by the rotor blade camber and/or incidence, and the fluid is discharged from the rotor with an absolute velocity ($V_{ro}$) which has both an axial component and a whirl component in the direction of rotation of the rotor. The fluid then flows into the passages between the stator blades 22, in which, at the design point, little or no diffusion takes place, the function of the stator 20 being predominantly to turn the fluid such that it is discharged from the stator with an absolute velocity ($V_{so}$) which has: the same (or nearly the same) axial component; and a whirl component which is the same (or nearly the same) as the whirl component entering the stator, but in the opposite direction. As may be seen from the velocity diagram shown in FIG. 3 of the drawings, the absolute velocity of the fluid passing through the stator vane passages ($V_{si}$, $V_{so}$) is maintained substantially constant during this whirl direction reversal process.

The fluid, with an absolute velocity component contrary to the direction of rotation of the rotor 16, then flows into the passages between the rotor vanes of the next rotor stage (not shown), and the whirl generation in that rotor then turns the flow such that on exit from the second rotor stage the fluid has a whirl component in the same direction as the direction of rotation of the rotor.

Thus, as is evident from the Figures, the function of alternate rotors and stators is simply to impart positive and negative whirl, respectively, to the fluid. The passage cross-sectional area in the stator is advantageously kept constant, or slightly convergent divergent, to maximize the efficiency of the whirl reversal process in the stators. While little or no diffusion of the fluid flow takes place in the stator vane passages between successive rotors, it is preferable that some provision for fluid diffusion is made after the last stage, for example by providing a bladed diffuser or volute, as is well known to those of skill in the art.

Figure 2:
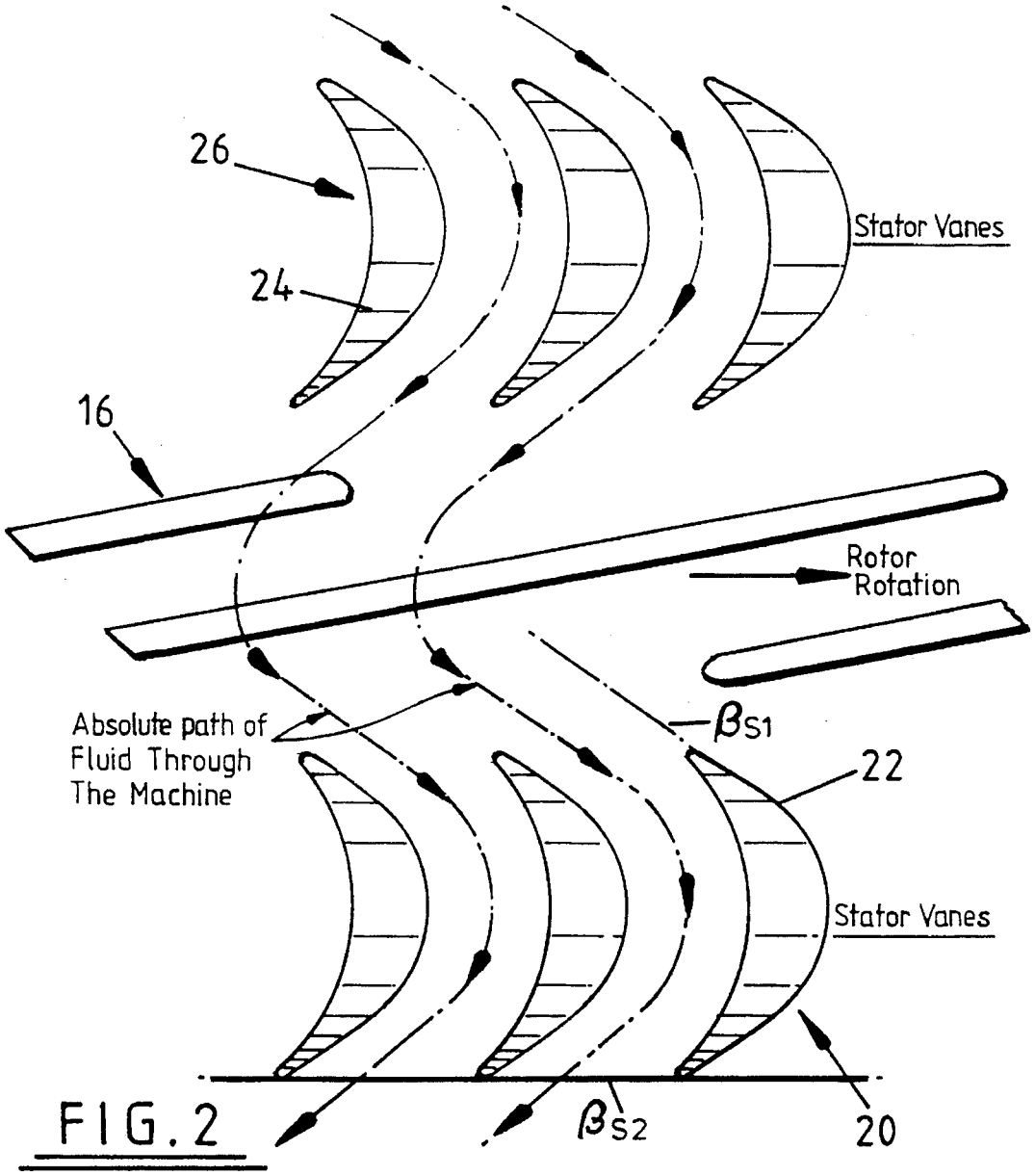
FIG. 2 is a somewhat schematic representation of the fluid path through a stator, a rotor and a further stator of a multistage pump in accordance with an embodiment of the present invention.

In such a multistage fluid machine, the first pump stage can be designed with or without provision to create fluid whirl in a direction contrary to rotor rotation upstream of the first stage rotor, depending upon the net positive suction head requirements at the first stage. FIG. 2 illustrates the situation where an upstream stator 26 is provided to impart whirl upstream of the rotor 16.

It has been found that pumps designed as described above may provide comparatively high stage pressures for a given rotor tip velocity, with relatively low rotor vane hydraulic loadings. It is thus practicable to design multistage axial flow pumps and compressors which can compete favorably on performance and economic terms with centrifugal and mixed flow pumps. There is considerable flexibility in pump design available, so that head/flow and power/flow characteristics may be selected to suit particular applications and system requirements. Further, using the above-described rotor and stator configuration, axial length per stage is less than with the equivalent conventional axial flow and mixed flow machines, allowing the manufacture of pumps and compressors with stiff, rugged shafts and rotor assemblies.

Figure 4:
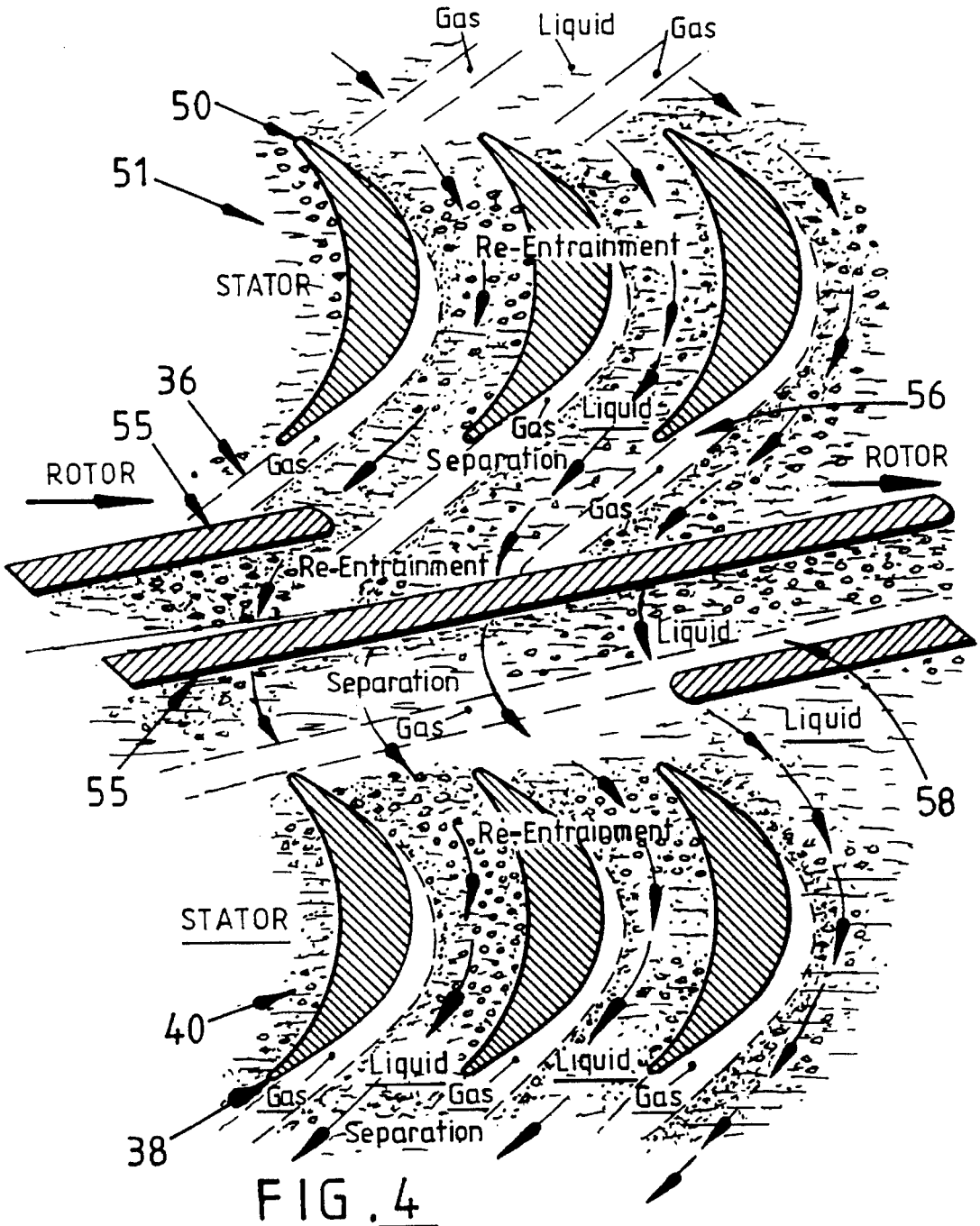
FIG. 4 is a somewhat schematic representation of the passage a multiphase fluid through the stator, rotor and a further stator of a multistage pump in accordance with a further embodiment of the present invention.

Reference is now made to FIG. 4 of the drawings, which illustrates a section of a pump stage 30, similar to that described above with reference to FIG. 2, being utilised to pump a multiphase fluid.

Figure 3:
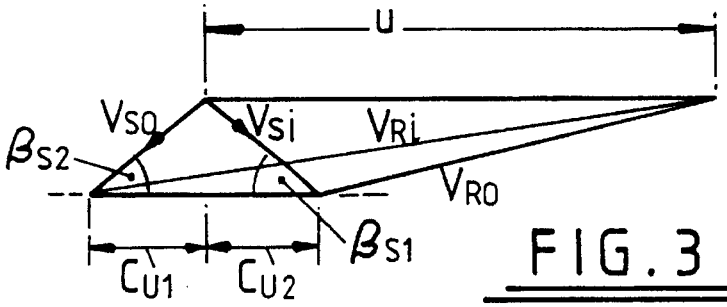
FIG. 3 is a velocity diagram of fluid passing through the rotor and the stator of the pump of FIG. 1.

FIG. 3 illustrates three blades 50 of a first upstream stator 51 and three blades 38 of a second downstream stator 40, the impeller or rotor 36 being located therebetween. The Figure also illustrate the process of separation and re-entrainment that occurs as a multiphase fluid passes through the pump stage.

As mentioned above with reference to the first-described embodiment, it will be noted that the passage cross-section between the stator blades 50, 38 is substantially constant such that the stators 51, 40 do not diffuse the fluid. It will also be noted that the stator blades 50, 38 are bulled-nosed and thus less sensitive to the incidence angle of fluid flowing into the stators.

As the fluid flows between the stator blades 50, and is subject to a first change in whirl direction, a degree of separation may occur in the low pressure area 56 along the trailing edge of each blade 50. However, the separated gas phase is re-entrained with the liquid phase on encountering the leading edges of the rotor blades 55, which induce whirl in the opposite direction. As the fluid passes through the rotor, a certain degree of separation may take place in the low pressure area 58 along the front face of the trailing edge of each rotor blade 55. On passing from the rotor and into the stator 40 and separated gas phase is re-entrained within the liquid phase, as the whirl direction is changed once more. On the fluid flowing from the stator 40 there is the possibility of some separation occurring in the low pressure area 60 along the trailing edge of each stator blade 38.

Thus, it will be seen that, although an inevitable degree of separation does take place as the fluid passes through the pump stage, any significant separation of the phases tends to be followed by re-entrainment. In addition, the changes in whirl velocity direction as the fluid flows through the stage results in the maximum whirl velocity attained in the stage being considerably lower than in a conventional axial pump configuration, thus reducing the centrifugal forces acting on the fluid and which tend to separate the phases. Also, the changes in whirl velocity direction avoids the fluid being subject to a continuous centrifuging effect.

It will be clear to those of skill in the art that the above-described embodiments are merely exemplary of the present invention and that various modifications and improvements may be made thereto, without departing from the scope of the invention, for example the illustrated embodiments feature machines with a cylindrical hub and a cylindrical casing, and for certain applications the same general flow principles may be incorporated into pumps or compressors with conical hubs and/or conical casings.

I claim:

1. An axial flow pump for use in pumping a multiphase fluid, the pump comprising at least one stage having a rotor for imparting whirl in one direction and two stators for imparting whirl in the opposite direction to maintain entrainment of the gas phase of the fluid within the liquid phase, one stator being upstream of the rotor and the other stator being downstream of the rotor.

2. The pump of claim 1, wherein the rotor has a cylindrical hub and rotates within a cylindrical housing.

3. The pump of claim 1, wherein means for diffusion of the fluid is provided after the last pump stage.

4. The pump of claim 1, wherein said at least one stage includes two stators, one upstream and one downstream of the rotor, the rotor arranged to induce whirl in one direction and the stators arranged to induce whirl in the opposite direction.

5. The pump of claim 1, wherein the rotor is in the form of an impeller mounted on a rotatable shaft.

6. The pump of claim 1, wherein a stator is provided downstream of the rotor and has bull-nosed vanes capable of tolerating a wide range of flow incidence angles.

7. The pump of claim 1, wherein the rotor is in the form of a series of impellers mounted on a rotatable shaft.

8. The pump of claim 1, wherein the rotor has a fluid flow coefficient of less than 0.4.

9. The pump of claim 8, wherein the rotor has a fluid flow coefficient of between 0.15 and 0.25.

10. A multistage axial flow pump or compressor comprising at least one stage including a rotor for imparting whirl in one direction and an inter-stage stator for imparting whirl in the opposite direction and having a plurality of vanes defining curved arcuate passages therebetween, the cross-sectional area of each passage being substantially constant along the whole length of the curved arc of each passage whereby the stator produces little or no diffusion.

11. The pump of claim 10, wherein the rotor has a cylindrical hub and rotates within a cylindrical housing.

12. The pump of claim 10, wherein the stator is configured such that, at or near the design duty flow, the fluid is discharged from the stator with an absolute velocity which has substantially the same axial component as the fluid entering the stator, and has a whirl component of velocity which is substantially the same as the whirl component entering the stator, but in the opposite rotational direction.

13. The pump of claim 10, wherein means for diffusion of the fluid is provided after the last pump stage.

14. The pump of claim 10, wherein the rotor of a second pump stage is arranged to impart a whirl component in the same direction as the direction of rotation of the rotor of the first stage.

15. The pump of claim 10, wherein said at least one stage includes two stators, one upstream and one downstream of the rotor, the rotor arranged to induce whirl in one direction and the stators arranged to induce whirl in the opposite direction.

16. The pump of claim 10, wherein the rotor is in the form of an impeller mounted on a rotatable shaft.

17. The pump of claim 10, wherein the stator is mounted to the casing which defines the outer wall of the pump stage.

18. The pump of claim 10, wherein a stator is provided downstream of the rotor and has bull-nosed vanes capable of tolerating a wide range of flow incidence angles.

19. The pump of claim 10, wherein the stator is configured such that, at or near the design duty flow, the fluid is discharged from the stator with an absolute velocity which has substantially the same axial component as the fluid entering the stator, and has a whirl component of velocity which is substantially the same as the whirl component entering the stator, but in the opposite rotational direction.

20. The pump of claim 10, wherein the rotor is in the form of a series of impellers mounted on a rotatable shaft.

21. The pump of claim 10, wherein the stator is formed of a plurality of radially extending blades or vanes.

22. The pump of claim 10, wherein the stator has bull-nosed vanes capable of tolerating a wide range of flow incidence angles.

23. The pump of claim 10, wherein the rotor has a fluid flow coefficient of less than 0.4.

24. The pump of claim 23, wherein the rotor has a fluid flow coefficient of between 0.15 and 0.25.

25. A method of pumping or compressing a fluid utilizing a multistage axial pump or compressor, the method including the steps of: imparting whirl to the fluid in a first rotor; and then imparting whirl to the fluid in the opposite direction in a first stator with little or not diffusion such that, at or near the design duty flow, the fluid is discharged from the stator with an absolute velocity with has substantially the same axial component as the fluid entering the stator, and has a whirl component of velocity which is substantially the same as the whirl component entering the stator, but in the opposite rotational direction.

* * * * *